US005162747A

United States Patent [19]

Tammaru

[11] Patent Number: 5,162,747

[45] Date of Patent: Nov. 10, 1992

[54] VELOCITY MODULATION MICROWAVE AMPLIFIER WITH MULTIPLE BAND INTERACTION STRUCTURES

[75] Inventor: Ivo Tammaru, Rancho Palos Verdes, Calif.

[73] Assignee: Hughes Aircraft Company, Los Angeles, Calif.

[21] Appl. No.: 657,570

[22] Filed: Feb. 19, 1991

[51] Int. Cl.[5] ..... H01J 25/61

[52] U.S. Cl. ..... 330/44; 330/45; 315/3.6; 315/5.43

[58] Field of Search ..... 315/5.39, 5.43, 5.51, 315/3.6; 330/44, 45

[56] References Cited

U.S. PATENT DOCUMENTS

| | | | |
|---|---|---|---|
| 2,954,553 | 9/1960 | Gruenberg | 315/3.6 X |
| 2,972,081 | 2/1961 | Bridges et al. | 333/230 X |
| 2,974,252 | 3/1961 | Quate | 315/5.43 X |
| 3,009,078 | 11/1961 | Ashkin | 315/5.51 X |
| 3,090,925 | 5/1963 | Adler et al. | 315/3.6 X |
| 3,101,449 | 8/1963 | Ashkin | 315/543 X |
| 3,227,959 | 1/1966 | Kluver | 315/39.3 X |
| 3,258,706 | 6/1966 | Sturrock | 315/5.39 X |
| 3,264,568 | 8/1966 | Goerz, Jr. et al. | 315/39.3 X |
| 3,289,032 | 11/1966 | Rubert et al. | 315/5.39 |
| 3,753,030 | 8/1973 | McManus | 315/39.3 X |
| 4,931,695 | 6/1990 | Symons | 315/5.39 |

*Primary Examiner*—Eugene R. LaRoche
*Assistant Examiner*—Benny T. Lee
*Attorney, Agent, or Firm*—Jeannette M. Walder; Terje Gudmestad; W. K. Denson-Low

[57] ABSTRACT

Two or more signal interaction structures (16,18), which may be klystron or traveling wave structures (32,50), are axially disposed in series between an electron gun (12) and a collector (14) for selectively velocity modulating an electron beam (20) generated by the gun (12) with a microwave input signal (IN1,IN2) and extracting a resulting amplified microwave output signal (OUT1,OUT2) from the beam (20). The interaction structures (16,18) are designed to operate in different frequency bands, for example the X and Ku bands, with only one of the structures (16,18) having an input signal (IN1,IN2) applied thereto at any given time. The interaction structures (16,18) are further designed such that the structures (16,18) which are not being used do not affect the structure (16,18) which is being used.

11 Claims, 2 Drawing Sheets

VELOCITY MODULATION MICROWAVE AMPLIFIER WITH MULTIPLE BAND INTERACTION STRUCTURES

BACKGROUND OF THE INVENTION

1. Field of the Invention

The present invention relates to a velocity modulation microwave amplifier which is capable of selectively amplifying one of two or more microwave input signals in different frequency bands.

2. Description of the Related Art

Velocity modulation amplifier tubes which operate at microwave radio frequencies (RF) are widely used in communications, radar transmitters, and numerous other applications. The most common types of such amplifiers are klystrons and traveling wave tubes (TWTs). These amplifiers include an electron gun and focussing structure which generates a long cylindrical electron beam, an RF interaction structure which provides gain and power output by interaction with the beam, and a collector where the unused beam energy is converted to heat. The different types of amplifiers differ from each other principally in the configuration of the interaction circuit.

Klystron tubes include input and floating resonant cavities which cause velocity modulation and electron bunching of the beam, and one or more output cavities which extract RF energy by deceleration and demodulation of the bunched beam. Due to the relatively high quality factor (Q) of the resonant cavities, the bandwidth of a klystron tube tends to be relatively narrow.

In a TWT, the input RF energy propagates along a slowwave interaction structure in approximate synchronism with the electron beam. The bandwidth can be much larger than for a klystron, but the RF circuit is longer due to weaker interaction. To avoid regenerative oscillations arising from waves traveling both forward and backward in the structure, TWT circuits are severed into two or more independent sections. The increased length and complexity of a TWT makes this device generally more expensive than a klystron.

Hybrid velocity modulation tubes have also been developed which combine the features of uncoupled resonant cavity (klystron) and traveling wave structures. An extended interaction circuit (EIC) klystron uses long resonant cavities, each with several interaction gaps, in a configuration which resembles a traveling wave structure. Another hybrid structure combines a floating cavity klystron input section with an EIC output section. A detailed description of conventional velocity modulation amplifiers is found in a paper entitled "HIGH-POWER LINEAR-BEAM TUBES", by A. Staprans et al, Proceedings of the IEEE, vol. 61, no. 3, March 1973, pp. 299–330.

A conventional microwave amplifier, whether it be a klystron, TWT or hybrid, is capable of operating with usable efficiency only within a limited frequency band. In applications where operation in two or more widely separated frequency bands is required, it has generally been necessary to provide two separate microwave amplifier tubes, each with its own electron gun, collector, and power supply. This redundancy increases the size and cost of the system in which the amplifiers are employed.

SUMMARY OF THE INVENTION

In a microwave amplifier embodying the present invention, two or more signal interaction structures, which may be klystron or traveling wave structures, are axially disposed in series between an electron gun and a collector for selectively velocity modulating an electron beam generated by the gun with a microwave input signal and extracting a resulting amplified microwave output signal from the beam. The interaction structures are designed to operate in different frequency bands, for example the X and Ku bands, with only one of the structures having an input signal applied thereto at any given time. The interaction structures are further designed such that the structures which are not being used do not affect the structure which is being used.

The present invention overcomes the bandwidth limitations of conventional microwave amplifiers, while eliminating the redundancy of a separate electron gun, collector and power supply for each amplifier in a multiple band configuration. The present microwave amplifier is more efficient, compact, and inexpensive than multiple frequency amplifier configurations used in the past.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
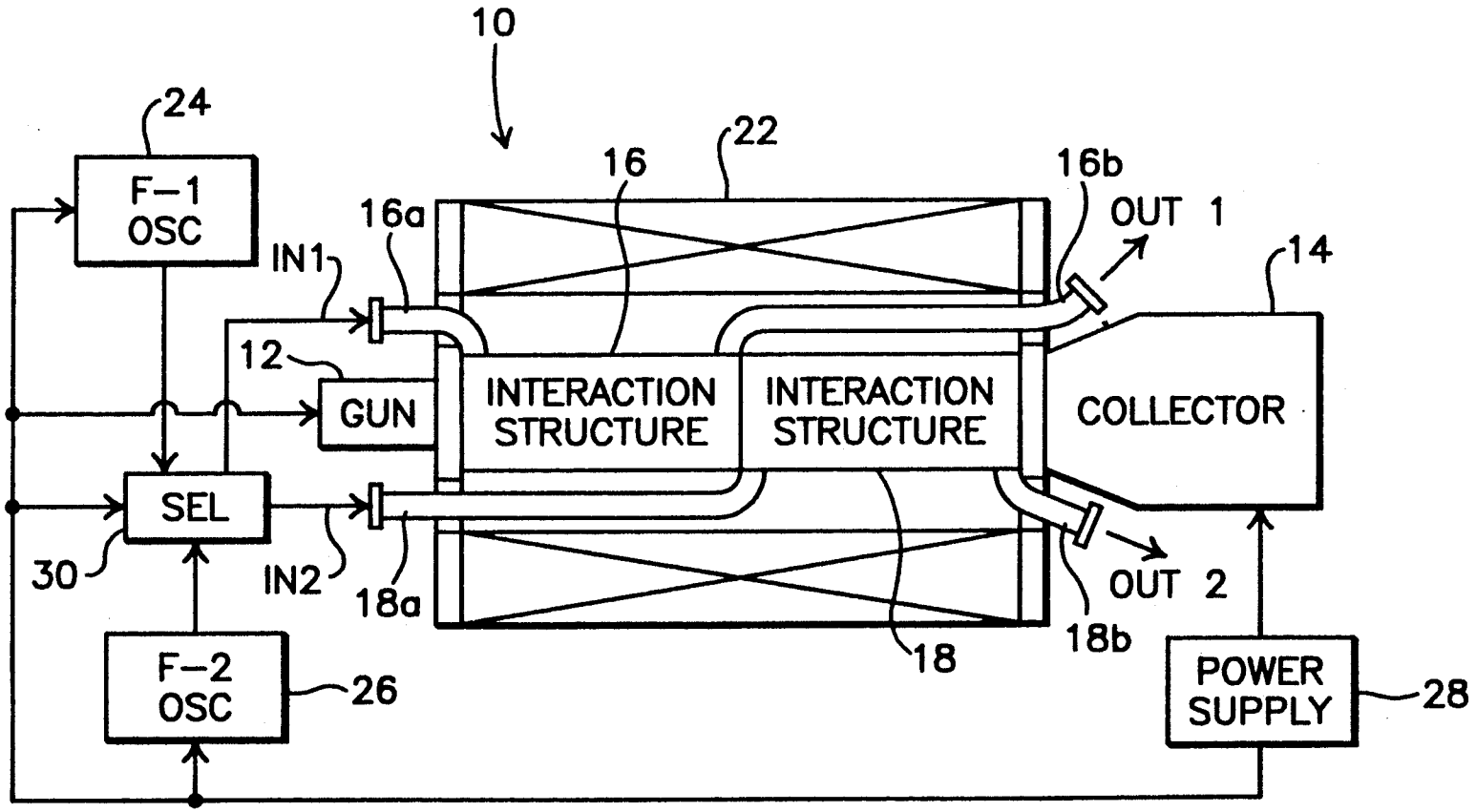
FIG. 1 is a simplified schematic diagram illustrating a microwave amplifier embodying the present invention including two signal interaction structures.

Referring to FIG. 1 of the drawings, a microwave amplifier embodying the present invention is generally designated as 10, and includes an electron gun 12 and collector 14. Although not shown in detail, the electron gun 12 includes an electron source, and accelerating and focussing elements arranged in any suitable known configuration. A first interaction structure 16 and a second interaction structure 18 are axially disposed in series between the electron gun 12 and collector 14, with the second structure 18 being located downstream of the first structure 16. The collector 14 may have multiple depressed stages (not shown) for high efficiency over the entire operating frequency range of the amplifier 10.

The amplifier 10 which is illustrated in FIG. 1 as including two interaction structures may be referred to as a Duotron TM. However, although not specifically illustrated, the scope of the invention is not so limited, and includes an amplifier configuration having three or more interaction structures. Such an amplifier may be referred to as a Polytron TM.

Figure 2:
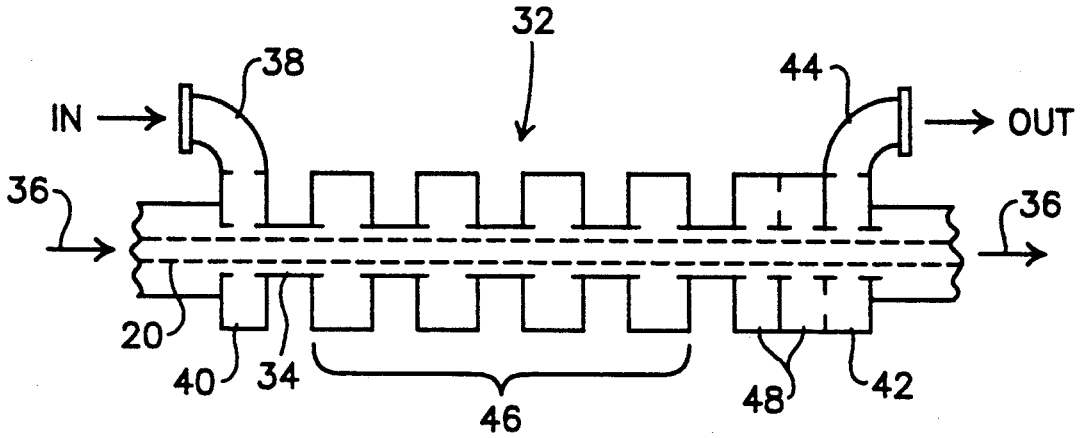
FIG. 2 is a simplified schematic diagram illustrating a klystron interaction structure which may constitute one or both of the signal interaction structures of the present amplifier.
Figure 3:
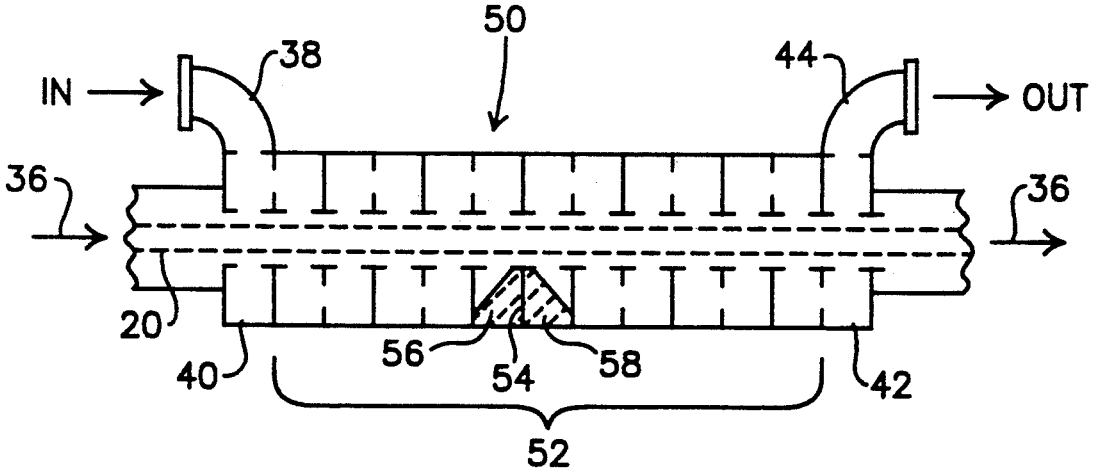
FIG. 3 is a simplified schematic diagram illustrating a traveling wave interaction structure which may constitute one or both of the signal interaction structures of the present amplifier.

The gun 12 generates a cylindrical electron beam 20 which is illustrated in FIGS. 2 and 3, which passes through the interaction structures 16 and 18 in axial alignment, and is finally captured by the collector 14 and converted to heat thereby. The amplifier 10 further includes a focussing structure 22 for preventing the electron beam 20 from diverging inside the interaction structures 16 and 18.

Oscillators 24 and 26 generate first and second electromagnetic input signals IN1 and IN2 at different microwave RF frequencies. For example, one of the signals IN1 and IN2 could be in the X-band and the other of the signals could be in the Ku-band, although the invention is not so limited. The interaction structure 16 includes an input coupler 16*a* and an output coupler 16*b*, whereas the interaction structure 18 includes an input coupler 18*a* and an output coupler 18*b*. The output of the amplifier 10 is taken from the output coupler 16*b* or 18*b* as an amplified output signal OUT1 or OUT2 respectively. Further illustrated is a power supply 28 which supplies requisite operating voltages to the electron gun 12, collector 14, oscillators 24 and 26, etc.

A selector 30 is provided between the oscillators 24 and 26 and the input couplers 16*a* and 18*a*. The selector 30 is constructed to selectively couple the first input signal IN1 from the oscillator 24 to the input coupler 16*a* of the interaction structure 16, or couple the second input signal IN2 from the oscillator 26 to the input coupler 18*a* of the interaction structure 18, but not both at the same time. Alternatively, although not shown, the oscillators 24 and 26 may be connected directly to the input couplers 16*a* and 18*a*, and the selector 30 replaced by an electrical switching means which selectively energizes only one of the oscillators 24 and 26 or otherwise functions to apply only one of the input signals IN1 or IN2 to the respective input coupler 16*a* or 18*a*. The amplified output signal OUT1 or OUT2 will appear at the output coupler 16*b* or 16*b* depending on which input signal IN1 or IN2 was applied to the respective input coupler 16*a* or 16*b*. Although not shown, waveguide means are provided to couple the output signal OUT1 or OUT2 to one or more radar transmitting antennas or other units.

The interaction structures 16 and 18 have a klystron, TWT, hybrid, or any other suitable type of velocity modulation configuration within the scope of the invention. Although in the most preferred form of the invention the structures 16 and 18 are both klystron structures, the invention is not so limited. The structures 16 and 18 may both be TWT structures, or one may be a klystron and the other a TWT structure. Klystron and TWT structures generally operate best with different beam parameters, with the klystron favoring a higher beam perveance and lower voltage, while two TWT structures in series tend to result in a rather long device. However, these factors may not be prohibitive in a particular application. In the case of a high power klystron structure, the focussing structure 22 is typically a solenoid, whereas in the case of a TWT structure, the focussing structure 22 is preferably a periodic permanent magnet (PPM) structure.

Either or both of the interaction structures 16 and 18 may be a klystron structure 32, as illustrated in FIG. 2. The electron beam 20 propagates through a central tube 34 from left to right as designated by arrows 36. A microwave input signal IN (IN1 or IN2 in FIG. 1) is applied to the structure 32 by means of an input coupler 38 and input cavity 40, whereas an amplified output signal OUT (OUT1 or OUT2 in FIG. 1) is extracted from the structure 32 by means of an output cavity 42 and output coupler 44. Depending on the operating frequencies and power levels, the couplers 38 and 44 may be embodied by coaxial cables, rather than hollow waveguides as illustrated.

The input signal IN modulates the electron beam 20 via the input cavity 40. A plurality of resonant uncoupled or floating cavities 46 are disposed between the input and output cavities 40 and 42 which constitute a bunching circuit. The cavities 46 are individually excited by the modulated electron beam 20. The resulting RF cavity fields enhance the modulation, causing the electron beam 20 to become strongly bunched and injected into the output cavity 42. The bunched electron beam 20 is decelerated in the output cavity 42, and the resulting amplified RF output signal OUT coupled out of the structure 32 through the output coupler 44. The output cavity 42 may be provided with an extended interaction circuit (EIC) including a plurality of coupled cavities 48 if desired to increase the bandwidth and power capabilities of the structure 32. Although an EIC has some similarity to a circuit section in a coupled-cavity TWT, it lacks an RF-absorbing termination at one end, and the entire multi-cavity chain is operated in a single resonant mode instead of a growing traveling-wave mode.

Either or both of the interaction structures 16 and 18 may alternatively be embodied by a TWT structure 50 as illustrated in FIG. 3. The structure 50 includes an input coupler 38, input cavity 40, output cavity 42 and output coupler 44 which perform the same functions as in the structure 32. However, the floating buncher cavities 46 of the structure 32 are replaced in the structure 50 by a slow wave structure including a plurality of coupled cavities 52. The electron beam 20 propagates from left to right as designated by arrows 36. A microwave input signal IN (IN1 or IN2 in FIG. 1) is applied to the structure 50 by means of an input coupler 38 and input cavity 40, whereas an amplified output signal OUT (OUT1 or OUT2 in FIG. 1) is extracted from the structure 50 by means of an output cavity 42 and output coupler 44.

The slow wave structure 52 provides a path for propagation of the electromagnetic wave which is considerably longer than the axial length of the structure 52, whereby the electromagnetic wave is made to propagate through the slow wave structure 52 at a phase velocity which is approximately equal to the propagation velocity of the electron beam 20. The interactions between the electrons in the beam 20 and the traveling wave cause velocity modulation and bunching of electrons in the beam 20. The net result is a transfer of energy from the electron beam 20 to the electromagnetic wave traveling through the slow wave structure 52, and exponential amplification of the traveling wave.

A coupled cavity circuit generally includes one or more severs that divide the structure into two or more independent gain sections to ensure RF stability. Dividing the circuit into smaller gain sections also minimizes gain variations with frequency. FIG. 3 illustrates a two-section circuit with a single sever 54. The sever 54, which consists of a cavity partition wall with no coupling hole for the RF wave, prevents propagation of the RF circuit wave in either direction between the two cavities on either side. The RF signal is transmitted in the forward direction only from one section to the next through the modulated electron beam 20. The cavities on either side of the sever 54 contain terminations 56 and 58 respectively, made of lossy ceramic material. The terminations are designed to absorb the RF wave traveling toward the sever 54 from either side with minimum power reflection.

The present amplifier 10 can provide a significantly improved capability for certain microwave systems at minimum cost. Instead of operating two separate microwave power tubes, each with its own power supply, only a single tube and power supply are required. An example would be a system with a high power klystron operating at X-band which requires an additional operating capability at Ku-band. A conventional klystron or TWT is not capable of covering both operating frequency bands with the required output power. However, by adding a Ku-band klystron interaction structure in series with the X-band structure on the same beam, the present amplifier 10 effectively acts like a single device that can operate over both bands.

Since the interaction structures 16 and 18 operate using a single electron beam 20, they must be mutually compatible with regard to beam focussing and RF characteristics. In particular, the beam tunnel, or inner diameter of the structure 18, must be at least as large as the beam tunnel of the structure 16 to allow the beam 20 to traverse both structures 16 and 18 without interception.

The interaction structure 18 is unaffected by the presence of the structure 16 when the second input signal IN2 is applied to the input coupler 18*a* thereof, since the electron beam 20 entering the structure 18 under these conditions is an unmodulated DC beam. When the first input signal IN1 is applied to the input coupler 16*a* of the structure 16, the beam 20 entering the structure 18 includes electrons with a large range of velocities and trajectory angles. The focussing field and beam hole of the structure 18 must be designed such that the spent beam from the structure 16 traverses the structure 18 with negligible interception to avoid damage thereto. This may be determined by conventional trajectory calculations.

A second requirement is that the structure 18 be nonresponsive to the RF modulation of the spent electron beam 20 emerging from the structure 16. The beam modulation contains components at the fundamental operating frequency as well as higher harmonics. The cavities of the structure 18, particularly the EIC cavities 48 where the structure 18 has the klystron configuration illustrated at 32 in FIG. 2, should have negligible interaction at these frequency components to prevent the structure 18 from producing undesired output power. Primarily, the EIC cavities should not have any resonances associated with the slot mode or higher order cavity modes of the structure 18 that are susceptible to excitation by the signal components of the modulated beam 20.

Regardless of which interaction structure 16 or 18 is being used, the structure 16 is not affected by the presence of the structure 18. Thus, the presence of the structure 18 places no additional constraints on the design of the structure 16. As a general guideline, the structure 16 should be designed for the frequency band which has the more difficult performance requirements.

EXAMPLE

An exemplary microwave amplifier 10 embodying the present invention may be designed using current technology components to satisfy the following performance characteristics.

The interaction structure 16 is a klystron structure operating at a center frequency of 10 GHz, has a bandwidth of 500 MHz, and produces output power of 20 KW CW.

The interaction structure 18 is a klystron structure operating at a center frequency of 15 GHz, has a bandwidth of 200 MHz, and produces output power of 10 KW CW.

A single coupled-cavity TWT, which inherently has a larger bandwidth than a klystron, could not cover both of these bands at the high power levels indicated.

The structure 16 has a bandwidth of 5%, which is relatively wide for a klystron. However, new approaches to buncher design, such as disclosed in U.S. Pat. No. 4,800,322, entitled "BROADBAND KLYSTRON CAVITY ARRANGEMENT", issued Jan. 24, 1989, to R. Symons, and U.S. Pat. No. 4,764,710, entitled "HIGH-EFFICIENCY BROAD-BAND KLYSTRON", issued Aug. 16, 1988 to F. Friedlander, in combination with an EIC design, described in the above referenced article by Staprans et al, make the configuration feasible. As discussed in an article entitled "AN EXPERIMENTAL CLUSTERED-CAVITY, KLYSTRON", by R. Symons et al, in 1987 Proceedings of the IEDM, pp. 153–156, the achievable bandwidth can be expected to range from 5% at the 5 kilowatt level to asmuch as 30% at the 50 megawatt level. Given the above operating requirements for the structure 16, and its associated beam current and beam size, the indicated performance band and output power for the structure 18 can be readily achieved.

While several illustrative embodiments of the invention have been shown and described, numerous variations and alternate embodiments willoccur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

I claim:

1. A microwave amplifier, comprising:

electron gun means for generating an electron beam which propagates along a predetermined axis;

collector means disposed along the predetermined axis for capturing the electron beam;

first interaction structure means having a first input for receiving a first microwave input signal in a first frequency band and a first output for transmitting a first output signal, wherein the first interaction structure means is positioned between the electron gun means and the collector means and disposed along the predetermined axis for receiving the electron beam and for velocity modulating the electron beam with the first microwave input signal and extracting the first output signal resulting from amplification of the first input signal in the first interaction structure means from the electron beam at the first output;

second interaction structure means having a second input for receiving a second microwave input signal in a second frequency band and a second output for transmitting a second output signal, wherein the second interaction structure means is positioned between the first interaction structure means and the collector means and disposed along the predetermined axis for receiving the electron beam and for velocity modulating the electron beam with the second microwave input signal and extracting the second output signal resulting from amplification of the second input signal in the second interaction structure means from the electron beam at the second output;

first means for generating the first input signal;

second means for generating the second input signal; and selecting means operatively coupled between the first means and the second means and between the first and second inputs for selectively coupling the first means to the first input of the first interactive structure means or the second means to second input of the second interactive structure means, but not both;

wherein the second interaction structure means is configured so as to be nonresponsive to the modulation of the electron beam resulting from the first interaction structure means.

2. A microwave amplifier as in claim 1, in which the first interaction structure means comprises a klystron structure.

3. A microwave amplifier as in claim 2, in which the second interaction structure means comprises a klystron structure.

4. A microwave amplifier as in claim 2, in which the second interaction structure means comprises a traveling wave structure.

5. A microwave amplifier as in claim 1, in which the first interaction structure means comprises a traveling wave structure.

6. A microwave amplifier as in claim 5, in which the second interaction structure means comprises a traveling wave structure.

7. A microwave amplifier as in claim 5, in which the second interaction structure means comprises a klystron structure.

8. A microwave amplifier as in claim 1, in which the second interaction structure means includes cavities and is configured such that resonances associated with a higher order cavity mode of the second interaction structure means lie outside the first frequency band and harmonics thereof.

9. A microwave amplifier as in claim 1, in which:

the first interaction structure means comprises a first klystron structure;

the second interaction structure means comprises a second klystron structure;

one of the first and second input signals is in the X-band; and the other of the first and second input signals is in the Ku-band.

10. A microwave amplifier as in claim 1, in which the second interaction structure means includes slot coupled cavities and is configured such that resonances associated with the cavity coupling slots lie outside the first frequency band and harmonics thereof.

11. A microwave amplifier as in claim 1, in which the first interaction structure means includes a first beam tunnel having a first cross-sectional dimension and wherein the second interaction structure means includes a second beam tunnel having a cross-sectional dimension which is at least as large in cross-sectional dimension as the beam tunnel of the first interaction structure means.

* * * * *